United States Patent [19]

Lynch

[11] Patent Number: 4,889,619

[45] Date of Patent: Dec. 26, 1989

[54] PACKAGE WITH A CRUMB TRAP

[76] Inventor: Bobby R. Lynch, R.R. 2, Box 57, Ozark, Mo. 65721

[21] Appl. No.: 211,834

[22] Filed: Jun. 27, 1988

[51] Int. Cl.[4] ..... B07B 1/46

[52] U.S. Cl. ..... 209/374; 209/260; 209/352; 209/373; 220/20.5; 222/189; 229/120.26; 426/112; 426/124; 426/189

[58] Field of Search ..... 209/370, 372, 373, 374, 209/235, 414, 614, 376, 352, 417, 259, 260; 426/112, 124, 115, 398; 222/189; 220/20.5, 225; 206/527; 229/120.32, 1.5 B, 120.26; D7/47, 79, 81; D9/366, 414, 417, 420, 421, 423

[56] References Cited

U.S. PATENT DOCUMENTS

| | | | |
|---|---|---|---|
| 11,898 | 11/1954 | Martin | 209/376 |
| 162,367 | 4/1875 | Feldmeier et al. | 209/372 X |
| D. 262,681 | 1/1982 | Dawson | D7/47 |
| 482,431 | 9/1892 | Andrews | 209/376 |
| 741,454 | 10/1903 | Byar | 209/376 |
| 779,820 | 1/1905 | Turlington | 209/376 |
| 2,516,471 | 7/1950 | Letsch | 209/357 |
| 4,061,782 | 12/1977 | Baxter | 229/1.5 B |
| 4,143,804 | 3/1979 | Visvydas | 229/120.26 X |

FOREIGN PATENT DOCUMENTS

| | | | |
|---|---|---|---|
| 6863 | of 1903 | United Kingdom | 209/370 |

*Primary Examiner*—Donald T. Hajec
*Attorney, Agent, or Firm*—Harold F. Mensing

[57] ABSTRACT

A package for holding frangible particulate material, such as breakfast cereal. The package is designed to separate the crumbs or fines from the larger or unbroken and more palatable particles of cereal and to trap the crumbs so they will not recombine with the more edible portion of the cereal when the container is upended to pour the cereal into a bowl. The package has a partition member insert comprised of an apertured screening section and at least one imperforate ramp section inclined towards the screening section. The screening and ramp sections are supported above the bottom of the container to provide for sifting of the crumbs through the screening section, while the package is in its normal upright position, and to allow the crumbs to gravitate into the trapping space, defined by the imperforate ramp section, the bottom closure and the surrounding walls, when the package is tilted during pouring.

3 Claims, 1 Drawing Sheet

PACKAGE WITH A CRUMB TRAP

BACKGROUND OF THE INVENTION

Generally speaking, this invention relates to a retail package for frangible particulate material, such as breakfast cereal. More specifically it relates to a package which enhances the separation of the crumbs or fines from the more appetizing portion of the cereal and traps the crumbs so they will not recombine with the more appetizing portion when it is poured from the package.

In the prior art there are numerous examples of sifting and straining devices for separating chaff, dust, fines, crumbs and liquid from particulate material. However, prior to this invention no one has developed a retail package for frangible particulate material which enhances the separation of an undesirable finer fraction of particulate material from a larger more desirable fraction while the package is being handled in an upright position. In view of the prior art it may seem obvious to provide a screen member or apertured grid in the bottom of a container, but to date no one has done so. Furthermore, it is not obvious, in the absence of the current disclosure, to include an imperforate ramp section that is inclined towards a screening section. This is particularly true in view of the fact that the ramp section serves a dual purpose of causing the finer particulate matter to gravitate toward the screening section when the container is jostled in an upright position and also provides a cul-de-sac or trap into which the finer fraction, which has passed through the screening section, slides when the package is tilted to pour out the larger particulate size fraction.

SUMMARY OF THE INVENTION

This invention comprises a package having a box or container with an upright peripheral sidewall and a bottom closure wall attached to the lower end thereof. A partition member having a peripheral shape that matches the cross sectional shape of the container sidewall is tightly fitted against the inside of the sidewall in a bottom portion of the container. The partition member has an apertured central panel and at least one adjoining imperforate ramp panel inclined downwardly towards the central panel. These panels are supported in a spaced relationship above the bottom closure member by one or more bolstering wall sections depending from the periphery of the partition member.

The invention summerized above will be understood best if the following detailed description of the invention is read with reference to accompanying drawings.

BRIEF DESCRIPTION OF-THE DRAWINGS

FIG. 1 is a sectional side view taken through the center of a container having a rectangular cross section, FIG. 2 is a cross sectional view taken along lines 2—2 of FIG. 1, FIG. 3 is a sectional view similar to FIG. 1 but of a circular container embodiment, and FIG. 4 is a cross sectional view taken along lines 4—4 of FIG. 3.

DETAILED DESCRIPTION OF THE DRAWINGS

Figure 1:
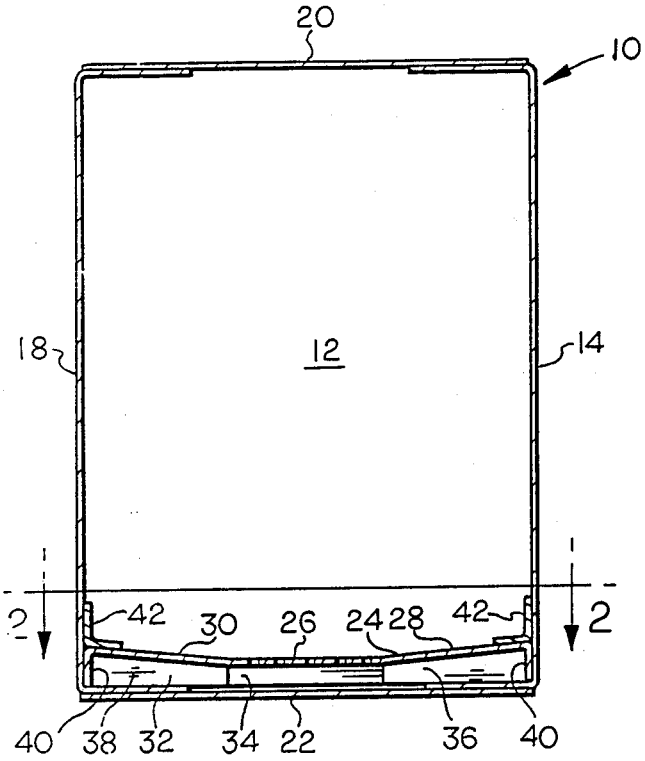
Figure 2:
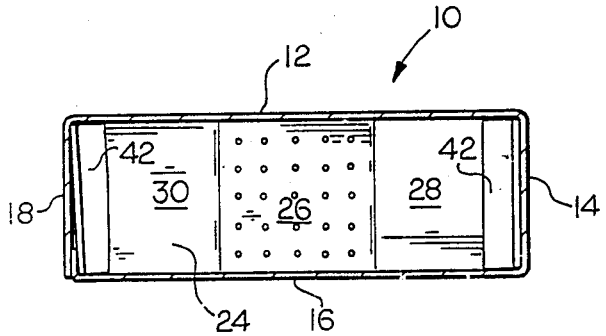

Referring primarily to the embodiment illustrated in FIGS. 1 and 2, it will be noted that the package 10 has a rectangular cross sectional shape which is a typical shape for a breakfast cereal box. The box portion of the package has four upright flat panel sidewalls 12, 14, 16 and 18 which are integrally joined together side-by-side to form its periphery. Two of them are relatively narrow and the other two are relatively wide. Top and bottom closure members 20 and 22 are provided on the respective top and bottom ends of the walls. Generally the sidewalls are provided with flaps which extend from their opposite top and bottom ends. The flaps are folded inwardly in an overlapping relationship to produce the respective closure members.

A partition member 24 having a peripheral shape which matches the cross sectional shape of the box is fitted in tight conformity against the inside of the box walls adjacent to their bottom ends. In instances where the box is provided with a plastic or waxed bag liner the partition member is inserted into the liner and the same tight fit is established between the partition and the box sidewalls. Partition member 24 has an apertured flat rectangular central plane or screening section 26 disposed in a parallel spaced relationship relative to the inside of the bottom closure 22. Two imperforate flat ramp panels or sections 28 and 30 extend from opposite ends of the screening panel where they are integrally attached to a fold line. The ramp sections are inclined downwardly from their outer ends towards the screening section. A bolstering wall 32 depends from the periphery of the partition member. In this embodiment the bolstering wall is made up of a number of flaps or sections which are integrally connected at fold lines to the outer edges of their respective partition sections. The pair of flaps 34 depending from the sides of the screening panel section 26 are of uniform height whereas the flaps 36 and 38, depending respectively from the sides of the ramp panel sections 28 and 30, increase in height in directions away from the screening section. The partition may also be provided with a pair of end flaps 40 depending from the outer end edges of the ramp panels. Preferably the lower edges of all of the depending flaps lie in a plane and bear against the inside of the bottom closure. An additional pair of flaps 42 may be adhered to the top surfaces of the ramp panel sections adjacent to their end edges, as shown, or be integrally attached to these edges and extend upwardly therefrom. These upwardly extending end flaps are biased against the corresponding sides of the box.

After the container has been filled with breakfast cereal or other frangible particulate material, the jostling and other normal movement of it which occur during subsequent handling causes any crumbs that are present to gravitate through the larger more stable particles to the bottom. The crumbs in the center of the container will fall through the apertures in the screening section and collect there while those on either side of the screening section will fall onto the surfaces of the ramp sections and then slide down the ramps onto the screening section where they will also fall through the apertures to the space below. The normal procedure for pouring the contents out of the container is to grasp it by its narrow side and tilt it about its lateral axis. In doing so the crumbs which have been collected beneath the screening section will slide to the lower end of the adjoining space and become trapped in the cul-de-sac beneath the imperforate ramp panel.

Figure 3:
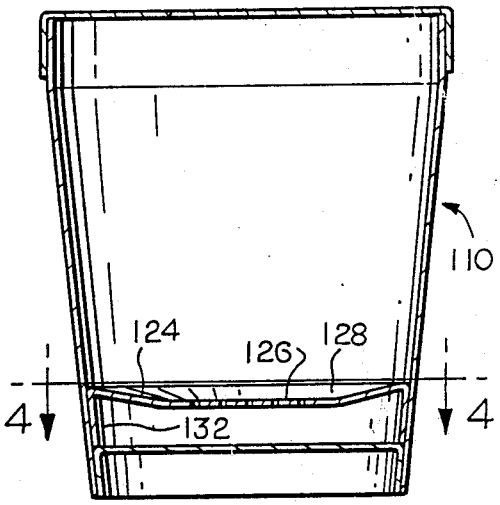
Figure 4:
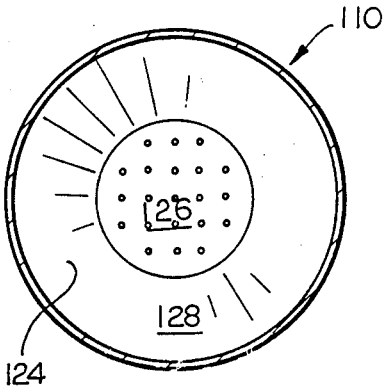

The embodiment illustrated in FIGS. 3 and 4 functions in substantially the same way as the previously described embodiment even though this package 110 has a circular cross section. The peripheral sidewall of the box portion of the package is frusto conical and converges in a downwardly direction. The partition member 124 is circular as is the centrally located screening section 126. The ramp section 128 is annular and is inclined downwardly from its periphery to the screening section. It also has a narrow frusto conical bolstering wall 132 of uniform height depending from its periphery. The screening section 126 and ramp section 128 are both concentric with the frusto conical sidewall of the box portion of the container. Tilting of this package in any direction will cause any crumbs that have collected in the space under the apertured screening section of the partition to slide under the adjoining imperforate ramp section and become lodged there.

While the invention has been described with respect to two embodiments having specific cross sectional shapes, it is to be understood that the teachings of this invention could be applied readily to containers having other cross sectional shapes. Accordingly the scope of the invention is to be determined primarily by the appended claims.

What is claimed is:

1. A package for containing frangible particulate material, said package comprising: an outer box having a frusto conical upright peripheral wall and a bottom closure wall attached to the bottom end of said peripheral wall, said walls being made of imperforate material, and a one-piece partition member extending entirely across a bottom portion of said outer box to an inside surface of said peripheral wall, said partition member being supported in a spaced relationship above said bottom closure wall by means of a frusto conical bolstering wall section depending from the periphery thereof to said bottom closure wall, said partition member having a circular screening section and an annular ramp section attached to a peripheral portion of said screening section, said ramp section extending from said screening section in an upwardly direction to said inside surface, and said screening section and ramp section being concentric with the upright peripheral wall.

2. A package for containing frangible particulate material, said package comprising: an outer box having a rectangular cross section defined by an upright peripheral wall and a bottom closure wall attached to the bottom end of said peripheral wall, said walls being made of imperforate material, and a one-piece rectangular partition member extending entirely across a bottom portion of said outer box to an inside surface of said peripheral wall, said partition member being supported in a spaced relationship above said bottom closure wall, by bolstering wall sections depending from the periphery thereof, said package having a screening section defined by an apertured panel in the center of said partition member and a confronting portion of said bottom closure wall, and cul-de-sac sections defined by the remaining portions of said bottom closure wall and portions of a pair of imperforate ramp panel sections of said partition, said ramp panel sections extending from opposite ends of said apertured panel in an upwardly direction to said inside surface, said bolstering wall section having sections of uniform height depending from said screening section to support said screening section parallel to said bottom closure wall and additional sections which depend from each of said ramp sections and increase in height in a direction away from said screening section to support said ramp sections on an incline relative to said bottom closure wall.

3. A package according to claim 2 further including wall sections extending upwardly from the ends of said ramp sections remote from said screening section.

* * * * *